US006968123B2

(12) United States Patent
Ravnbo-West et al.

(10) Patent No.: US 6,968,123 B2
(45) Date of Patent: Nov. 22, 2005

(54) ELECTRIC FIRE ASSEMBLY

(75) Inventors: Paul Ravnbo-West, Stoke-on-Trent (GB); Lee Cresswell, Stoke-on-Trent (GB); Michael John Green, Leek (GB); Mitchell Lee Cadd, Stoke-on-Trent (GB); Roy Berrisford, Stoke-on-Trent (GB); Kevin Regan, Stoke-on-Trent (GB)

(73) Assignee: CFM Corporation, Ontario (CA)

( * ) Notice: Subject to any disclaimer, the term of this patent is extended or adjusted under 35 U.S.C. 154(b) by 0 days.

(21) Appl. No.: 10/264,867

(22) Filed: Oct. 4, 2002

(65) Prior Publication Data

US 2003/0072565 A1 Apr. 17, 2003

(51) Int. Cl.[7] ..... F24D 13/00

(52) U.S. Cl. ..... 392/348; 40/428; 40/431; 362/806

(58) Field of Search ..... 392/348; 40/428, 40/431; 431/125; 219/220; 362/806; 126/500

(56) References Cited

U.S. PATENT DOCUMENTS

| | | | | |
|---|---|---|---|---|
| 1,514,552 A | | 11/1924 | McCormick | |
| 1,531,171 A | | 3/1925 | Berry et al. | |
| 1,590,083 A | | 6/1926 | Collins | |
| 1,703,761 A | | 2/1929 | Berry | |
| 1,719,622 A | | 7/1929 | Price | |
| 1,768,284 A | | 6/1930 | Berry | |
| 1,809,164 A | | 6/1931 | Gritt | |
| 1,824,388 A | | 9/1931 | Birch | |
| 1,827,941 A | | 10/1931 | Gross | |
| 1,843,279 A | | 2/1932 | Gritt | |
| 1,901,294 A | | 3/1933 | Gritt et al. | |
| 1,992,540 A | | 2/1935 | Newton | |
| 2,285,535 A | | 6/1942 | Schlett | |
| RE24,399 E | | 12/1957 | Brooks | 40/126 |
| 2,963,807 A | * | 12/1960 | Relph et al. | 362/806 |
| 2,984,032 A | | 5/1961 | Cornell | 40/106.52 |
| 3,395,475 A | | 8/1968 | Moss | 40/106.54 |
| 3,395,476 A | | 8/1968 | Moss et al. | 40/106.54 |
| 3,444,637 A | | 5/1969 | Joy | 40/106.53 |
| 3,496,335 A | | 2/1970 | Staats | 219/343 |
| 3,499,239 A | | 3/1970 | Mungo | 40/106.53 |
| 3,526,984 A | | 9/1970 | Nielsen et al. | 40/106.52 |

(Continued)

FOREIGN PATENT DOCUMENTS

| | | | | |
|---|---|---|---|---|
| BE | 772533 | * | 10/1971 | |
| BE | 808538 | * | 3/1974 | |
| GB | 272362 | | 6/1927 | |
| GB | 272836 | | 6/1927 | |
| GB | 322688 | | 12/1929 | |
| GB | 371732 | | 4/1932 | |
| GB | 414280 | | 8/1934 | |
| GB | 1024047 | | 3/1966 | |
| GB | 1088577 | | 12/1967 | |
| GB | 1164143 | | 9/1969 | F24C/15/06 |
| GB | 1372627 | | 11/1974 | G05D/23/30 |
| GB | 2072832 A | | 3/1981 | F24C/15/06 |
| GB | 2137336 A | | 3/1984 | F24C/15/06 |
| GB | 2180927 A | | 8/1984 | |
| GB | 2151772 A | | 11/1984 | F24C/15/06 |
| GB | 2198835 A | | 12/1986 | F24C/3/04 |
| GB | 2220000 A | | 6/1988 | G02B/5/32 |
| GB | 2298073 A | | 2/1995 | G09F/13/34 |
| GB | 2298073 | * | 8/1996 | |
| GB | 2321700 A | | 2/1997 | F24C/7/00 |
| GB | 2317224 A | | 9/1997 | F24C/7/00 |
| GB | 2337582 | * | 11/1999 | |
| WO | WO 97/41393 | | 4/1997 | F24C/7/00 |

*Primary Examiner*—John A. Jeffery
(74) *Attorney, Agent, or Firm*—Baniak Pine & Gannon

(57) ABSTRACT

An electric fire assembly with a flame effect arrangement. The arrangement includes a bulb located in a hollow cylindrical member of opaque material with a plurality of flame shape cutouts. Light passes through the cutouts onto the rear surface of a screen to provide a flame effect as the member rotates.

15 Claims, 4 Drawing Sheets

U.S. PATENT DOCUMENTS

| | | | | |
|---|---|---|---|---|
| 3,603,013 | A | 9/1971 | Reed et al. | 40/104.64 |
| 3,699,697 | A | 10/1972 | Painton | 40/106.53 |
| 3,742,189 | A | 6/1973 | Conroy et al. | 219/367 |
| 3,978,598 | A | 9/1976 | Rose et al. | 40/106.52 |
| 4,549,523 | A | 10/1985 | Hirauchi et al. | 126/97 |
| 4,573,905 | A | 3/1986 | Meyers | 431/125 |
| 4,890,600 | A | 1/1990 | Meyers | 431/125 |
| 4,965,707 | A | 10/1990 | Butterfield | 362/96 |
| 5,195,820 | A | 3/1993 | Rehberg | 362/523 |
| 5,642,580 | A | 7/1997 | Hess et al. | 40/428 |
| 6,053,165 | A | 4/2000 | Butler et al. | 126/512 |
| 6,162,047 | A | 12/2000 | Hess | 431/125 |
| 6,393,207 | B1 * | 5/2002 | Martin et al. | 392/348 |
| 2003/0049024 | A1 * | 3/2003 | Chen | 392/348 |
| 2003/0156828 | A1 * | 8/2003 | Jamieson et al. | 392/348 |
| 2005/0072031 | A1 * | 4/2005 | Hess et al. | 40/428 |
| 2005/0097793 | A1 * | 5/2005 | Hess | 40/428 |

* cited by examiner

ELECTRIC FIRE ASSEMBLY

FIELD OF THE INVENTION

This invention concerns improvements in or relating to electric fire assemblies, and particularly but not exclusively to such assemblies which provide a visual simulation of a natural fire, and also to improvements in or relating to flame effect arrangements.

BACKGROUND OF THE INVENTION

A number of electric fire assemblies, which provide a visual simulation of a natural fire by way of a flame effect have previously been proposed. In general, these have thus been relatively bulky and many have included quite complex arrangements and have thus been quite expensive to manufacture. Also the flame effect provided has often not always been wholly satisfactory.

There is a demand for a fire simulation device that combines superior performance and low costs. The present invention satisfies the demand.

SUMMARY OF THE INVENTION

According to the present invention there is provided an electric fire assembly comprising an electric heater and a flame effect arrangement, the arrangement comprising a light source, a rotatable light pattern provider comprising a hollow member which has a partial opaque pattern on the exterior, and an at least a translucent screen, the arrangement being configured such that the light from the light source is provided in the interior of the pattern provider directly onto the rear of the screen, such that as the pattern provider is rotated a changing pattern of light can be seen on the front of the screen whereby to provide a flame effect.

At least part of, and preferably the whole of, the light source may be located within the pattern provider. Preferably the light source is a substantially point light source, and desirably light from the light source is substantially focused onto the rear of the screen.

The pattern provider may comprise a cylindrical member. The pattern provider may comprise an opaque member with a plurality of openings or windows therein through which light can pass. Openings or windows are provided towards the lateral extremes of the pattern provider and are preferably inclined or bent outwardly in the direction of rotation to cause the light to be urged laterally outwards at the lateral extremes of the pattern on the screen.

A partially opaque filter member may be provided through which light passes between the pattern provider and the screen to break up the light into discrete portions on the screen. The filter member may be configured such that the light is broken up into flame shape portions.

The assembly may be arranged such that the light source and pattern provider are provided in an upper part of the assembly, and light therefrom shines downwardly and forwards onto the rear of the screen. The electric heater may be provided at the top of an upper part of the assembly, with the light source and pattern provider located immediately therebelow.

The screen and/or filter member may be inclined downwardly and rearwardly. The screen may be such as to appear substantially opaque, and desirably black, when no light shines onto the rear thereof. The screen may be such as to appear substantially orange where light is shone onto the rear thereof.

The assembly may be arranged such that at least some of the air entering the electric heater passes across the light source on the way to the heater, thereby providing cooling of the light source.

Two flame effect arrangements may be provided. The light pattern providers in the two arrangements may be arranged to rotate asynchronously relative to each other.

The assembly may also comprise an imitation coal, log or ember bed which can be illuminated. The bed may be located at or adjacent the lower end of the screen.

The invention also provides a flame effect arrangement, the arrangement being according to any of the preceding paragraphs.

These and other advantages, as well as the invention itself, will become apparent in the details of construction and operation as more fully described and claimed below. Moreover, it should be appreciated that several aspects of the invention can be used in other applications where a flame simulation would be desirable.

DETAILED DESCRIPTION OF A PRESENTLY PREFERRED EMBODIMENT

Figure 2:
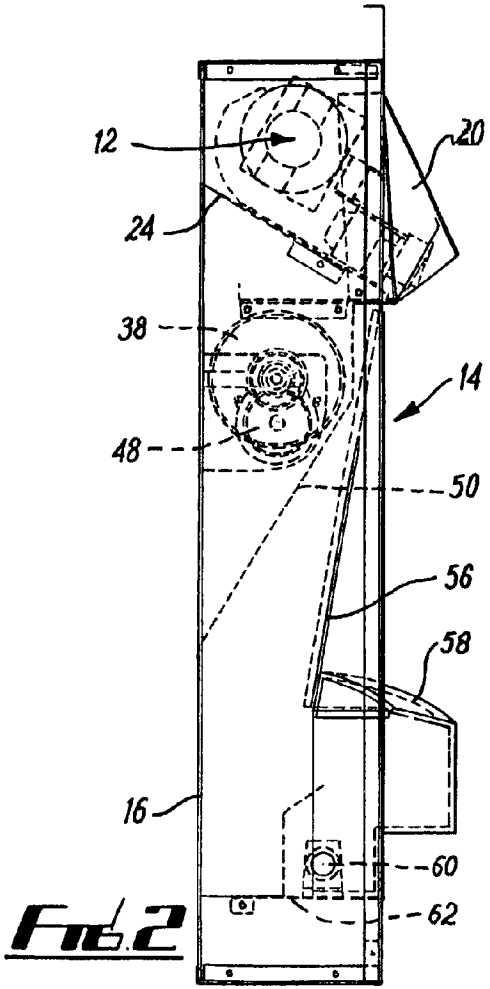
FIG. 2 is a diagrammatic side view of the assembly of FIG. 1.
Figure 1:
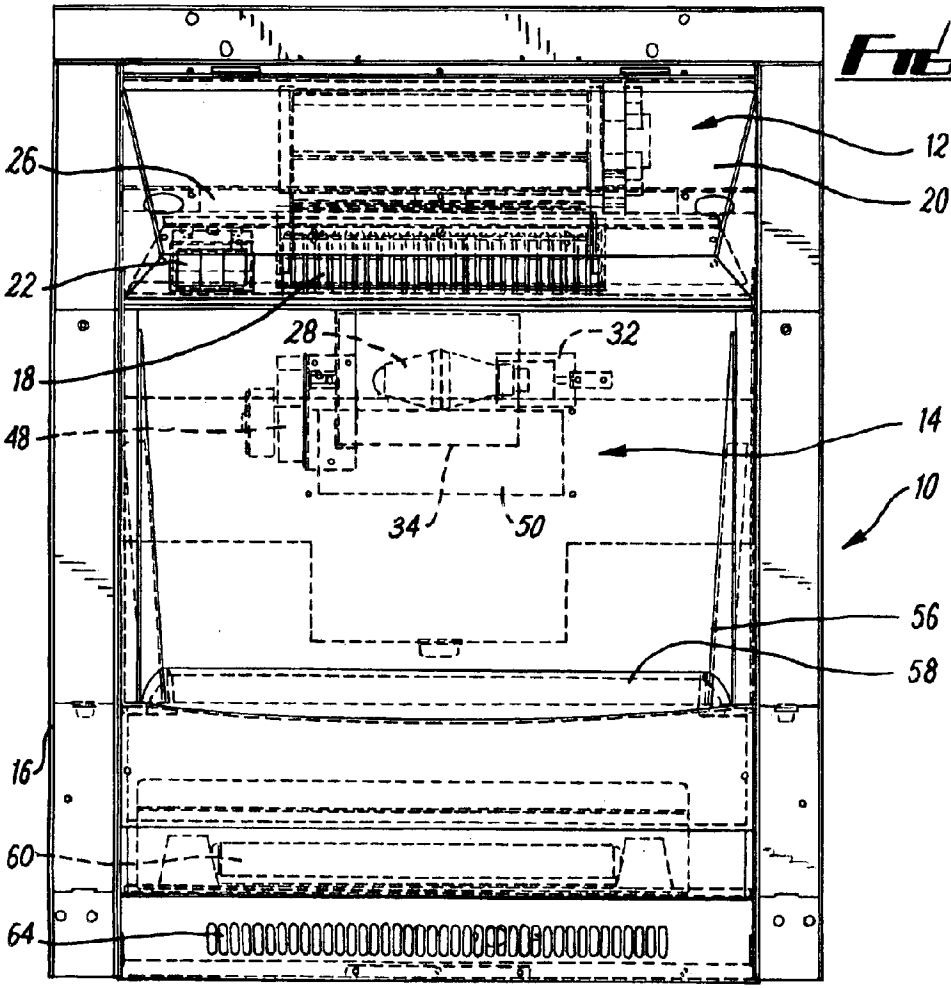
FIG. 1 is a diagrammatic front view of an electric fire assembly according to the invention.
Figure 3:
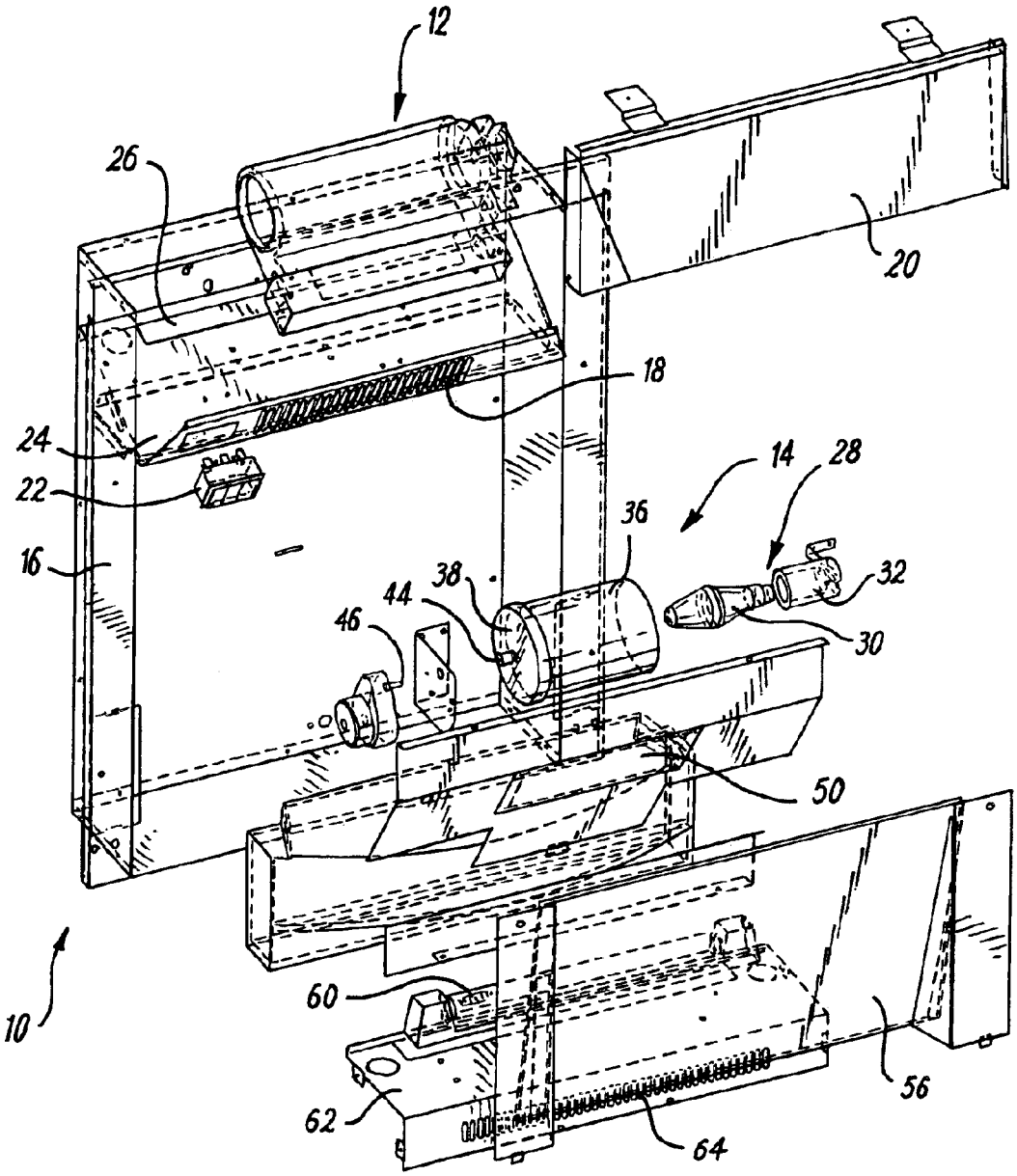
FIG. 3 is a diagrammatic perspective exploded front view of the assembly of FIG. 1.

FIGS. 1–6 show an electric fire assembly 10 comprising an electric heater 12 and a flame effect arrangement 14. The assembly 10 comprises a conventional rectangular cross-section casing 16. The heater 12 is located at an upper part of the casing 16 and is in the form of an essentially conventional electric fan arrangement directing heated air forwards and downwards through a vent 18 beneath a cowling 20. Controls 22 for the assembly 10 are provided adjacent the vent 18. The heater 12 is mounted on a plate 24, which is inclined downwardly in a forward direction and has an opening 26 at its rear to receive air to be heated.

Figure 4:
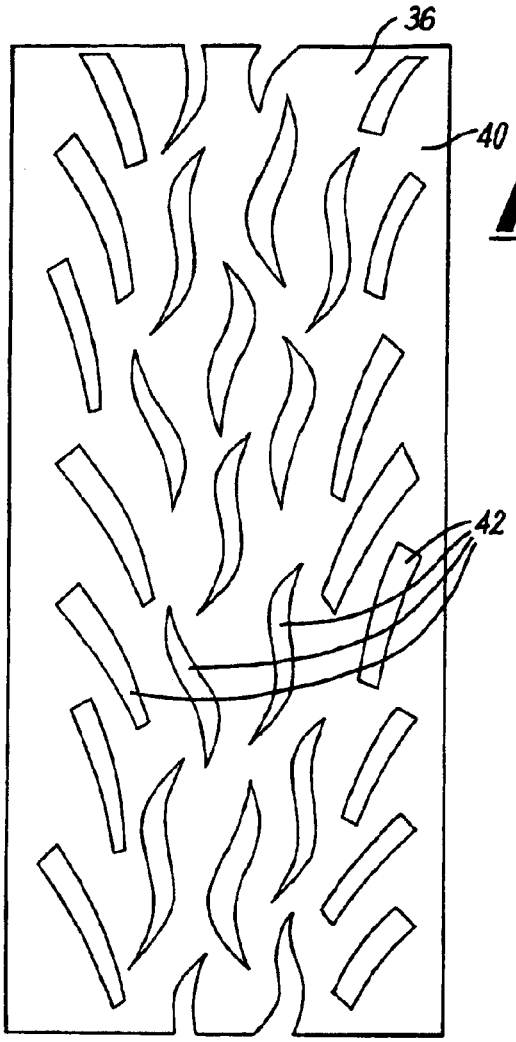
FIG. 4 is a plan view of a disassembled component of the assembly of FIG.1.
Figure 5:
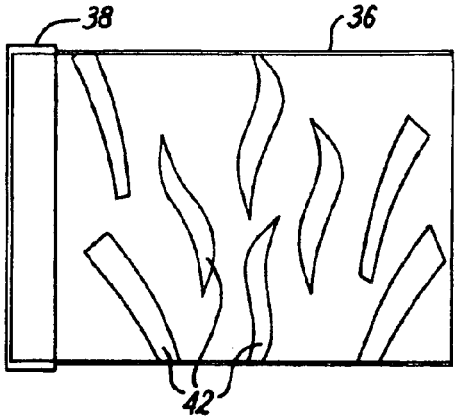
FIG. 5 is a view of the component of FIG. 4 in an assembled condition.

The flame effect arrangement 14 comprises a light source 28 in the form of a substantially point light source bulb 30. The bulb 30 is mounted in a holder 32 and extends into a pattern provider 34. The pattern provider 34 comprises a hollow cylindrical member 36 with an opaque end cap 38. A strip 40 of material best shown in FIG. 4 provides the walls of this cylindrical member 36. The material is opaque and includes a plurality of cutouts 42 which permit light to pass therethrough. The cutouts 42 have a generally flame shape in a mid-portion of the strip 40 and at each end curve outwardly. The end cap 38 has a central collar 44 mounted on a spindle 46 of an electric motor 48, which causes rotation of the pattern provider 34. The pattern provider 34 is mounted immediately beneath the heater 12.

Figure 6:
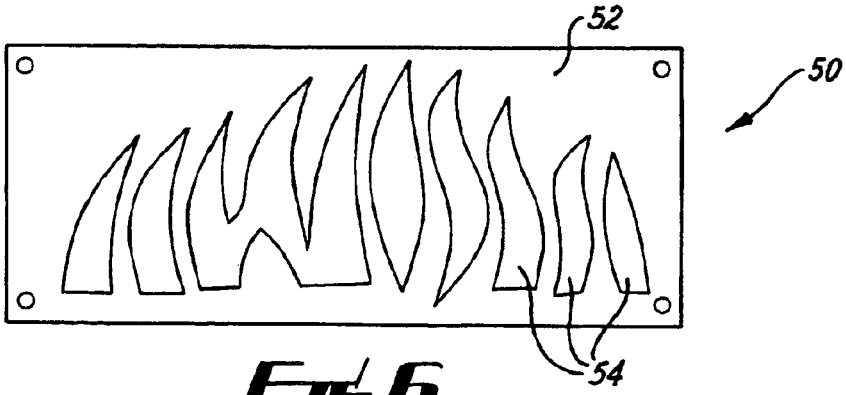
FIG. 6 is a plan view of a further component of the assembly of FIG. 1.

Beneath the pattern provider 34 is a filter member 50 in the form of an opaque sheet 52 and a plurality of cutouts 54 therein of shapes to simulate flames. Part of the sheet 52, which includes the cutouts 54, is illustrated in FIG. 6. The sheet 52 in inclined downwardly in a rearwards direction.

In front of the sheet 52 and inclined rearward, but at a shallower angle is a screen 56. The screen 56 is colored black and orange such that when no light is shone on the rear thereof it appears opaque and black. When light is shone onto the rear of the screen 56 it appears generally orange, through with very bright light this will tend to yellow and approaching white, whilst a duller light will be orange or when very dull almost red.

In use the flame effect arrangement 14 operates as follows. The light source 28 provides a substantially point light source which is substantially focused onto the rear of the screen 56. Light from the light source 28 passes through the cutouts 42 in the pattern provider 34, which is rotated. This therefore provides a changing pattern of light. This changing pattern of light shines through the filter member 50 and is thus divided up into discrete flame shape portions by the cutouts 54. This light impinges on the rear of the screen 56 to provide a flame like pattern colored as indicated above, which constantly changes as different light is shone through the filter member 50 and hence onto the rear of the screen 56.

The assembly 10 also comprises an imitation coal bed 58, which extends outwardly from a lower end of the screen 56. A strip light 60 illuminates the coal bed 58. The strip light 60 is mounted on a plate 62 which at its front lower part has downwardly turned part of which provides a vent 64 through which air is drawn into the assembly 10 to pass up to the heater 12. The assembly 10 is arranged such that air entering the vent 64 will substantially pass over the light source 28 thus providing cooling thereof and thereby prolonging the working life of the bulb 30.

Figure 7:
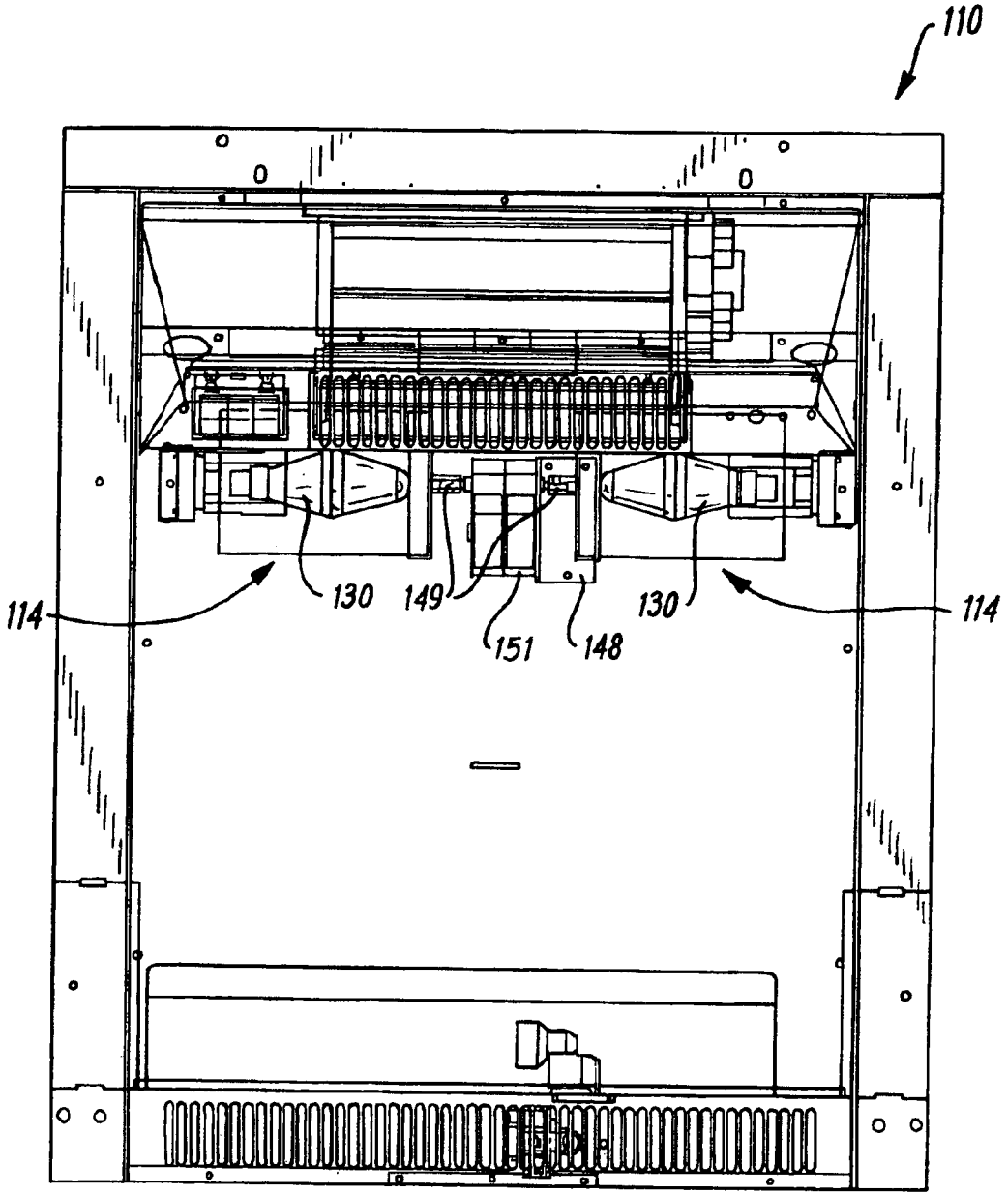
FIG. 7 is a view similar to FIG. 1, but of a second electric fire.

FIG. 7 shows an electric fire assembly 110, which is largely similar to the assembly 10 except that two flame effect arrangements 114 are provided, and only the significant differences in the assembly 110 will now be described. The arrangements 114 are similar to the arrangement 14 and are coaxially mounted with the sockets of their bulbs 130 outermost.

A motor 148 is provided which connects to respective spindles 149 to rotate the respective pattern providers 134. The motor 148 connects to the spindles 149 through gearing 151, which causes asynchronous rotation of the pattern providers. This asynchronous rotation provides for an almost randomly changing flame effect, thereby increasing the realism thereof.

There are thus described an electric fire assembly with a flame effect arrangement which provides for a very realistic flame effect. Also, the above-described arrangement, and particularly the feature of the light source being located within the pattern provider and the light being shone directly onto the rear of the screen, provides for a very compact arrangement thereby permitting a relatively narrow assembly illustrated, to be produced. The assembly is also of relatively straightforward construction and can thus be inexpensively manufactured for long and substantially maintenance free operation.

Various modifications may be made without departing from the scope of the invention. For instance, a different pattern of cutouts in the pattern provider and/or filter member could be incorporated. It may be possible for instance for two pattern providers to be provided, each with a respective point light source. These may be in the form of a pair of cylindrical members driven for instance by a single motor or multiple motors, and which members may be slightly out of synch to provide a constantly changing pattern.

Whilst the above-described assembly is an electric fire, it is to be realized that flame effect arrangements according to the invention could be incorporated in other types of heaters or perhaps other decorative arrangements.

Whilst endeavoring in the foregoing specification to draw attention to those features of the invention believed to be of particular importance it should be understood that the Applicants claim protection in respect of any patentable feature or combination of features hereinbefore referred to and/or shown in the drawings whether or not particular emphasis has been placed thereon.

While the apparatus and method herein disclosed forms a preferred embodiment of this invention, this invention is not limited to that specific apparatus and method, and changes can be made therein without departing from the scope of this invention, which is defined in the appended claims.

What is claimed is:

1. An electric fire assembly comprising:

an electric heater; and a flame effect arrangement, the arrangement including a light source, a rotatable pattern provider including a hollow member having a partial opaque pattern defined by cutouts formed through the hollow member, and at least a translucent screen, the arrangement being configured such that light from the light source is provided in an interior of the pattern provider and shines through the cutouts directly onto a rear surface of the screen, such that as the pattern provider is rotated, a changing pattern of the light can be seen on the screen whereby to provide a flame effect, in which at least part of the light source is located within the pattern provider, and in which a partially opaque filter member is provided through which the light passes between the pattern provider and the screen to break up the light into discrete portions on the screen.

2. An assembly according to claim 1, in which all of the light source is located within the pattern provider.

3. An assembly according to claim 1, in which the light source is a substantially point light source.

4. An assembly according to claim 3, in which the light from the light source is substantially focused onto the rear surface of the screen.

5. An assembly according to claim 1, in which the pattern provider comprises a cylindrical member.

6. An assembly according to claim 1, in which the pattern provider comprises an opaque member with a plurality of flamed-shaped cutouts formed on and adjacent a mid-span of the opaque member through which the light can pass.

7. An assembly according to claim 1, in which openings are provided towards lateral extremes of the pattern provider, at least one of said openings is inclined and bent outwardly in direction of rotation to cause the light to be urged laterally outwards at the lateral extremes of the pattern on the screen.

8. An assembly according to claim 1, in which the filter member is configured such that the light is broken up into flame shape portions.

9. An electric fire assembly comprising:

an electric heater; and a flame effect arrangement, the arrangement including a light source, a rotatable pattern provider including a hollow member having a partial opaque pattern defined by cutouts formed through the hollow member, and at least a translucent screen, the arrangement being configured such that light from the light source is provided in an interior of the pattern provider and shines through the cutouts directly onto a rear surface of the screen, such that as the pattern provider is rotated, a changing pattern of the light can be seen on the screen whereby to provide a flame effect, in which the assembly is arranged such that the light source and the pattern provider are provided in an upper part of the assembly, and the light therefrom shines downwardly and forwards onto the rear surface of the screen.

10. An assembly according to claim 9, in which the electric heater is provided at a top of the upper part of the assembly, with the light source and the pattern provider located immediately therebelow.

11. An assembly according to claim 1, in which one or both of the screen and the filter members are inclined downwardly and rearwardly.

12. An electric fire assembly comprising:

an electric heater; and a flame effect arrangement, the arrangement including a light source, a rotatable pattern provider including a hollow member having a partial opaque pattern defined by cutouts formed through the hollow member, and at least a translucent screen, the arrangement being configured such that light from the light source is provided in an interior of the pattern provider and shines through the cutouts directly onto a rear surface of the screen, such that as the pattern provider is rotated, a changing pattern of the light can be seen on the screen whereby to provide a flame effect, in which the assembly is arranged such that at least some air entering the electric heater passes across the light source on the way to the heater, thereby providing cooling of the light source.

13. An assembly according to claim 1, in which the assembly also comprises an imitation coal, log or ember bed that can be illuminated.

14. An assembly according to claim 13, in which said bed is located at or adjacent a lower end of the screen.

15. An electric fire assembly comprising:

an electric heater; and a flame effect arrangement, the arrangement including a light source, a rotatable pattern provider including a hollow member having a partial opaque pattern defined by cutouts formed through the hollow member, and at least a translucent screen, the arrangement being configured such that light from the light source is provided in an interior of the pattern provider and shines through the cutouts directly onto a rear surface of the screen, such that as the pattern provider is rotated, a changing pattern of the light can be seen on the screen whereby to provide a flame effect, in which two flame effect arrangements are provided, and in which the rotatable pattern provider in each of the two arrangements are arranged to rotate asynchronously relative to each other.

* * * * *